United States Patent [19]

Maruhashi et al.

[11] 4,314,847

[45] Feb. 9, 1982

[54] PROCESS FOR DEPHOSPHORIZATION AND DENITRIFICATION OF CHROMIUM-CONTAINING IRON

[75] Inventors: Shigeaki Maruhashi; Morihiro Hasegawa; Takashi Yamauchi, all of Yamaguchi, Japan

[73] Assignee: Nisshin Steel Company, Ltd., Tokyo, Japan

[21] Appl. No.: 161,815

[22] Filed: Jun. 23, 1980

[51] Int. Cl.[3] ..... C21C 7/02

[52] U.S. Cl. ..... 75/51; 75/58; 75/130.5

[58] Field of Search ..... 75/51-58, 75/130.5

[56] References Cited

U.S. PATENT DOCUMENTS

| | | | |
|---|---|---|---|
| 3,158,466 | 11/1964 | Muller | 75/53 |
| 3,309,196 | 3/1967 | Kaneko | 75/53 |
| 3,320,052 | 5/1967 | Bowden | 75/53 |
| 3,333,954 | 8/1967 | Dawson | 75/53 |
| 3,748,121 | 7/1973 | Atterbury | 75/53 |

*Primary Examiner*—P. D. Rosenberg
*Attorney, Agent, or Firm*—Ladas & Parry

[57] ABSTRACT

A process for dephosphorization-denitrification of Cr-containing pig iron by oxidizing refining is disclosed. Said process comprises maintaining the C concentration of the molten metal at not less than 2%, contacting it with a slag comprising at least one of fluorides and chlorides of alkaline earth metals, at least one of oxides, hydroxides and carbonate of alkali metals, at least one of oxides of iron and nickel, while controlling oxidation of Cr.

15 Claims, 1 Drawing Figure

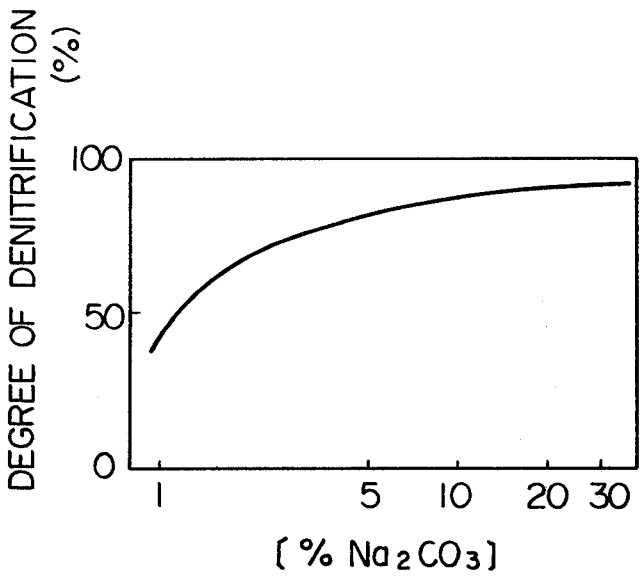
DEGREE OF DENITRIFICATION (%)
100
50
0
1
5
10
20
30
[% Na2CO3]

PROCESS FOR DEPHOSPHORIZATION AND DENITRIFICATION OF CHROMIUM-CONTAINING IRON

TECHNICAL FIELD OF THE INVENTION

This invention relates to a process for dephosphorization and denitrification of chromium-containing pig iron (pig iron containing not less than 3% of chromium (Cr), hereinafter simply referred to as "the Cr pig iron").

BACKGROUND OF THE INVENTION

It is the understanding of those skilled in the art that if the content of carbon (C), phosphorus (P) and nitrogen (N) of stainless steels is much more reduced than performed today, very excellent materials will be obtained. That is, it is well known that good toughness and corrosion resistance are achieved by reducing the content of C and N, and hot cracking and stress corrosion cracking can be avoided by reducing the content of P and N. Although now the C content can be reduced considerably, there is no effective and economical method for reducing the content of P and N of the stainless steels.

The reason why dephosphorization and denitrification of stainless steels is difficult is that Cr increases solubility of N in iron, and Cr is oxidized preferentially to P. The solubility of N in molten pig iron containing 3% Cr is about 1.5 times as much as that in plain pig iron. As to P, very low P content stainlsss steels can be produced by carefully selecting low P content materials, although the resulting products inevitably become of high price. But as to N, we cannot resort to such means. Therefore, for the purpose of denitrifying the Cr pig iron, not a few complicated methods have been proposed, such as combination of vacuum melting and electron-beam melting, or denitrifying the Cr pig iron with aluminum (Al) first and thereafter oxidizing the residual Al together with C. However, the combination of evacuation melting and electron-beam melting requires costly equipment and operation cost is high, too. The denitrification by means of Al as disclosed in Japanese Laying-Open Patent Publication No. 98318/74, for instance, requires removal of the Al that remains in iron in an amount of order of several percents. Further the formed Al nitride must be separated from molten iron. But some portion of AlN remains in the molten iron, which decomposes at the later decarburization stage and the N dissolves in the iron again.

As for the dephosphorization of plain pig iron, rather recently, it has been proposed for that purpose to incorporate oxides, carbonates, chlorides of alkali metals in the smelting slags. For instance, in Japanese Laying-Open Patent Publication No. 2322/78, "a dephosphorization agent to be used for dephosphorizing molten pig iron comprising a mixture of lime, iron ore, soda ash and fluorite, characterized in that iron oxide is added in an amount not less than 2.5 times the weight of the oxide or carbonate of an alkali metal, the ingredients are mixed and pulverized and heated at 600° C. or higher so that compounds of iron oxides and alkali metal oxides are formed, and CaO is added in an amount from equal with to 10 times the amount of said compounds" is disclosed. In Japanese Laying-Open Patent Publication No. 26715/78, "an auxiliary refining agent for molten iron containing an alkali metal compound, to which a $SiO_2$-containing material containing not less than 50% $SiO_2$ and/or a $SiO_2$-containing material in which the total content of $SiO_2$, $Na_2O$, MnO and FeO is not less than 60% is added, whereby the amount of $SiO_2$ and the $SiO_2$-containing material is respectively 20% or less and 50% or less" is disclosed. Further in Japanese Laying-Open Patent Publication No. 28511/78, "a dephosphorization, desulfurization or dephosphorization-desulfurization slag comprising 30–70% CaO, 10–40% $CaF_2$ as the principal ingredients, and 1–30% of at least one of $Na_2O$, $B_2O_5$, $Na_2B_4O_7$, $K_2O$, $Li_2O$, NaCl, KCl, and LiCl" is disclosed.

However, all these slags or refining agents may be effective for plain pig iron, but they are quite ineffective for dephosphorization of the Cr pig iron. All the descriptions of these three quoted Japanese Laying-Open Patent Publications relate to dephosphorization of plain pig iron and there is no reference to dephosphorization of the Cr pig iron.

Difficulty of dephosphorization of the Cr pig iron is considered to be as follows.

The oxidation reactions of P, Cr and iron (Fe) are regarded to be as follows:

| | | | |
|---|---|---|---|
| $2P + \frac{5}{2} O_2 = P_2O_5$ | $3.73 \times 10^{-9}$ | atm | (1) |
| $2Cr + \frac{3}{2} O_2 = Cr_2O_3$ | $5.07 \times 10^{-14}$ | atm | (2) |
| $Fe + \frac{1}{2} O_2 = FeO$ | $1.37 \times 10^{-9}$ | atm | (3) |

The numerical value for pressure indicated on the right side of each equation represents the equilibrium oxygen (O) partial pressure under the standard state at 1500° C. for each substance. It will be learned from these data that Cr combines with oxygen far easier than P and Fe. This fact is one of the reasons that the dephosphorization of the molten Cr pig iron is extremely difficult in comparison with that of molten plain pig iron containing no Cr. That is to say, in the prior art processes, the intention to dephosphorize by oxidation resulted in oxidation of Cr only, and oxidation of P did not occur. Even if P is oxidized, Cr is oxidized far more. Also it has been learned that the produced oxide of Cr (referred to as $Cr\text{-}_2O_3$) impairs dephosphorizing power of the slag. It is understood that the formed $Cr_2O_3$ acts as an acidic oxide and combines with $P_2O_5$-fixing materials and substantially reduces their $P_2O_5$-fixing ability. That is, in the case of the Cr pig iron, the fixation of the formed $P_2O_5$ is difficult, that is, the so-called rephosphorization becomes a serious problem.

Therefore, in order to carry out dephosphorization of the Cr pig iron, it is necessary to promote the reaction $$2P + 5FeO \rightarrow P_2O_5 + 5Fe \quad (4)$$

and at the same time to control as much as possible the reaction $$2Cr + 3FeO \rightarrow Cr_2O_3 + 3Fe \quad (5)$$

The known measures for oxidizing a molten iron bath as controlling oxidation of Cr therein are to reduce the partial pressure of CO of the atmosphere. Specifically speaking, it is known to reduce the pressure of the surrounding atmosphere or to contact a gaseous mixture of an oxidizing gas such as oxygen (O) and an inert gas such as argon (Ar) with the molten iron bath.

It is another means for dephosphorizing while controlling oxidation of Cr to reduce the oxygen potential of the iron bath. The decrease in the oxygen potential of the iron bath can be achieved by increase in the silicon (Si) content in the bath. But it is not desirable because Si is oxidized to $SiO_2$, which lowers basicity of the slag. In this respect, carbon (C) is oxidized to produce CO which has no influence on the slag property. Therefore increase in the carbon content of the bath is preferred.

According to the knowledge hitherto, as noted in Japanese Laying-Open Patent Publication No. 28511/78 quoted above, which relates to the plain carbon steel, and foreseen from the above equation (1), it is thought that in order to promote oxidation of P, the oxygen potential of the iron bath should be raised. In the case of the Cr pig iron, however, it was quite unknown whether oxidation of P (dephosphorization) will satisfactorily occur or not, if the oxygen potential of the iron bath is lowered in order to control oxidation of Cr.

As for the denitrification of the Cr pig iron, two of us noticed that alkali metal carbonates have some effect for denitrifying as well as dephosphorizing the Cr pig iron, and patent applications were made therefor in Japan (Japanese Laying-Open Patent Publication No. 84113/77 and No. 023816/78). In these inventions, the molten Cr pig iron is contacted with neat alkali metal carbonates or a slag containing not less than 30% by weight of alkali metal carbonates, and as the slag ingredients $SiO_2$, $CaF_2$, $Fe_2O_3$, CaO, etc. are referred to. These ingredients were intended for merely reducing vaporization loss of alkali metal carbonates. No definite idea was established with respect to slag composition, and it was considered that the principal role of denitrification and dephosphorization was played by the alkali metal compounds through and through.

After repeated experiments, we found that a slag comprising $Li_2O$ or $Li_2CO_3$ (the Li compound), a fluoride or chloride of an alkaline earth metal, and an oxide of Fe or Ni is effective for dephosphorization as well as denitrification and we provided a process for dephosphorization-denitrification of molten pig iron containing not less than 3% Cr, comprising maintaining the Si content of said molten iron at 0.2% by weight or less, contacting said pig iron with a slag comprising 30–80% by weight of at least one selected from fluorides and chlorides of alkaline earth metals, 0.4–30% by weight of at least one selected from lithium oxide and lithium carbonate (the Li compound), 5–50% by weight of at least one of iron oxides and nickel oxide, and 0–40% by weight of at least one selected from oxides and carbonates of alkaline earth metals, while controlling oxidation of Cr, which is the subject matter of our co-pending U.S. application Ser. No. 159,097 filed June 13, 1980.

In the course of our study, we gradually came to notice that dephosphorization and denitrification of the Cr pig iron is effected not only with the slag containing the Li compound but also with the slag containing other alkali metal compounds. We further proceeded with study on this theme and we now provide a novel process for dephosphorization-denitrification of the Cr pig iron.

DISCLOSURE OF THE INVENTION

According to this invention a process for dephosphorization-denitrification of molten pig iron containing not less than 3% of the Cr is provided, said process comprises maintaining the C concentration thereof at 2% by weight or higher, contacting said molten pig iron with a slag comprising 30–70% by weight of at least one selected from fluorides and chlorides of alkaline earth metals, 1.5–30% by weight of at least one selected from oxides, hydroxides and carbonates of sodium (Na) and potassium (K), 5–50% by weight of at least one selected from oxides of iron and nickel, and 0–40% by weight of at least one selected from oxides and carbonates of alkaline earth metals, while controlling oxidation of Cr.

In the process of this invention, the C concentration of the iron bath must be not less than 2%. Carbon (C) decreases the solubility of N in molten iron, promotes denitrification reaction, prevents formation of $Cr_2O_3$ during dephosphorization-denitrification treatment, and maintains the slag in good conditions. The closer the C concentration of the iron bath is to the saturation, the more preferably the denitrification reaction is promoted.

The Si concentration of the iron bath should preferably be not more than 0.2% for the purpose of dephosphorization. The reason is that Si is preferentially oxidized and impairs oxidation of P, and the formed $SiO_2$ combines with the P-fixing agent to decrease the basicity of the slag, resulting in poor refining.

In the slag used in the process of this invention, from more than 30 to 70% by weight of at least one of fluorides and chlorides of alkaline earth metals (hereinafter referred to simply as the halide component) must be contained. Specifically, fluorides and chlorides of alkaline earth metals mean $CaF_2$, $CaCl_2$, $MgF_2$, $MgCl_2$, etc. These compounds react with P and N and improve the fluidity of the slag. Therefore these are essential components for dephosphorization and denitrification, and main ingredients of the slag. Proper compound or compounds should be selected by considering physicochemical properties such as melting point, volatility, hygroscopicity as well as cost. From the viewpoints of ease in handling, cost and efficiency in dephosphorization and denitrification, $CaF_2$ is the most suitable. At the content of not more than 30%, the halide component cannot exhibit satisfactory effect as the reactant the fluidity-improver. More than 70% of this component can be contained, but it is limited to 70% in consideration of contents of the other components. The preferred content thereof is 35–60%, and the more preferred content is 40–60%.

In the slag used in the process of this invention, from 1.5 to less than 30% by weight of at least one of carbonates, oxides and hydroxides of sodium and potassium (hereinafter referred to simply as the alkali metal compound component) must be contained. The alkali metal compound component remarkably improves fluidity of the slag, and has strong affinity with $SiO_2$, $Al_2O_3$, $B_2O_3$, $Cr_2O_3$, etc. which have deleterious effects on dephosphorization and denitrification, and thus lessens their deleterious effects. From the view point of ease in handling, carbonates are preferred. Major part of these carbonates is converted to oxides at the steel-making temperature, generating $CO_2$. At the content thereof less than 1.5%, practically useful degree of dephosphorization and denitrification cannot be achieved. Even if more than 30% thereof is contained, the degree of dephosphorization-denitrification is saturated, simply resulting in economic loss. The preferred content of the alkali metal compound component is 3–20% and the more preferred content is 5–15%.

In the slag used in the process of this invention, 5–50% by weight of at least one of oxides of iron (Fe) and nickel (Ni), specifically, FeO, $Fe_2O_3$, NiO (hereinafter referred to simply as the oxide component), etc., is contained. This component is usually used in the from of iron ores, scale, nickel oxide sinter. These are used for oxidizing the metal bath. For the purpose of dephosphorization-denitrification, it is advantageous to oxidize the metal bath. The content of the oxide component is determined by how remarkable the oxidation of Cr in the metal bath is. It is needless to say that in order to suppress oxidation of Cr, the smaller content of oxides of iron and/or nickel, is preferred. In the prior art process, wherein neat carbonates of alkali metals were used, the generated $CO_2$ gases played an important role as the oxidizer. In that case, if the amount of the alkali metal carbonate necessary for dephosphorization and denitrification is determined, the amount of the $CO_2$ to be generated is automatically determined, too. In the case of the slag used in the process of this invention, however, the amount of the $CO_2$ is rather small because the amount of the used alkali metal compounds is small. Therefore, the oxidizing power of the slag is freely changed by modifying the amount of the oxide component in the slag. This is one of the characteristics of the slag used in the process of this invention. For instance, when the oxidation of Cr is remarkable, it is possible to reduce the oxidizing power only by reducing content of the oxide component without reducing the amount of the alkali metal compound component. When the Cr oxide content in the slag is increased, there is disadvantage that the refining power of the slag is lowered and the slag easily solidifies. At the content of 5–50% of the oxide component, good results are obtained. When the content is less than 5%, the oxidation of the iron bath is dissatisfactory, and thus dephosphorization and denitrification are dissatisfactory, too. On the other hand, at the content in excess of 50%, the fluidity of the slag is impaired, and in the worst case, the slag solidifies and the dephosphorization-denitrification reaction does not proceed satisfactorily. The preferred range is 15–50% and the more preferred range is 20–40%.

In the refining of the Cr pig iron, $SiO_2$ and $Cr_2O_3$ are deleterious ingredients of the slag, which inevitably come from the refractory materials. They should be excluded as much as possible because they combine with the alkali metal compounds and CaO and thus decrease the refining power of the slag. In order to counteract the deleterious effect thereof, the slag used in the process of this invention may contain less than 40% by weight of at least one of oxides and carbonates of alkaline earth metals, specifically speaking, CaO, $CaCO_3$, etc. (hereinafter referred to simply as the alkaline earth metal compound component). From the view point of ease in handling and cost, CaO is preferred. Calcium oxide (CaO) is advantageously used for adjustment of basicity, melting temperature, viscosity, etc. of the slag and protection of the refractory materials. As well known, addition of CaO raises melting temperature of the slag. Therefore, when the good fluidity of the slag is required or contamination with the deleterious $SiO_2$ etc. is negligibly small, it is desirable to add little or no alkaline earth metal compound component.

Alkaline earth metal oxides and carbonates play a role as the reactant in dephosphorization and denitrification, too. But necessary amount thereof is produced by oxidation of fluoride or chloride of alkaline earth metals within the slag even if they are not intentionally added. Therefore, the content of the alkaline earth metal compound component is less than 40%. If 40% or more than thereof is contained, it impairs fluidity of the slag, and retards the dephosphorization and denitrification reaction, and in the worst case, it solidifies the slag. The preferred content is 5–20% and the more preferred content is 7–15%.

Concerning the dephosphorization of the Cr pig iron with the slag containing at least one of lithium oxide and carbonate, at least one of fluorides and chlorides of alkaline earth metals, and at least one of oxides of iron and nickel, which may contain at least one of oxides and carbonates of alkaline earth metals, we found that there is a relation represented by the following inequality between the temperature and Cr concentration and C concentration.

$$1600^\circ\,C. \geqq t^\circ c \geqq [-35960/\{\log([\%Cr]^2/[\%C]^3)-21.88\}-273]^\circ C. \quad (6)$$

which is described in detail in our co-pending U.S. application Ser. No. 159,097 filed June 13, 1980.

We have found that this relation is applicable to the dephosphorization of the Cr pig iron with the slag explained in the above, too.

At temperatures lower than that defined by the above inequality, oxidation of Cr is promoted, Cr oxide concentration in the slag increases, and the slag solidifies inhibiting the dephosphorization reaction. On the other hand at temperatures in excess of 1600° C., the dephosphorization products become unstable, and decompose.

The above inequality is applicable to denitrification, and in this case, denitrification satisfactorily takes place at temperatures up to 1850° C. therefore, when only denitrification is concerned, the treatment can be carried out at temperatures defined by the following inequality.

$$1850^\circ\,C. \geqq t^\circ C. \geqq [-35960/\{\log([\%Cr]^2/[\%C]^3)-21.88\}-273]^\circ C. \quad (7)$$

In the process of this invention, the slag can be contacted with the iron bath in various ways. The slag is divided into portions and is contacted with the iron bath portion by portion, whereby each portion can be contacted therewith by a different manner. For instance, one portion is introduced into the bath per se from the bottom of the bath, and the remaining portion is placed on the surface of the bath.

In the process of this invention, the amount of the slag to be used is not critical. But usually it is used in an amount of 5–80 kg/ton-metal, preferably 10–60 kg/ton-metal. As the amount of the alkali metal compound component, it is used in an amount 1–24 kg/ton-metal, preferably 3–12 kg/ton-metal.

We can regard that the process is industrially effective and significant if 50% reduction in the P content is achieved as to dephosphorization and 60% reduction in the N content is achieved as to denitrification.

The degree of dephosphorization is defined as:

$$\frac{[\%P]\text{ before treatment} - [\%P]\text{ after treatment}}{[\%P]\text{ before treatment}} \times 100\ (\%)$$

In the same way the degree of denitrification is defined as:

$$\frac{[\%N] \text{ before treatment} - [\%N] \text{ after treatment}}{[\%N] \text{ before treatment}} \times 100\ (\%)$$

Now the invention is explained in detail in reference to the sole attached drawing.

BRIEF DESCRIPTION OF THE ATTACHED DRAWING

The sole attached drawing shows the relation between degree of denitrification and concentration of $Na_2CO_3$ added in the used slag in denitrification of Cr pig iron containing 18% Cr.

DETAILED DESCRIPTION OF THE INVENTION

Having noted denitrification ability of the above-mentioned slag composition, we studied the relation between degree of denitrification and slag composition. That is, we carried out denitrification treatment of Cr pig iron containing 18% Cr, using slags consisting of 20% FeO, varied amounts of $Na_2CO_3$ and balance $CaF_2$ at 1550° C. Three (3) kg of the slag was used per 100 kg of molten iron.

As learned from this drawing, and as explained in the above, the preferred amount of $Na_2CO_3$ is 3–20%, the more preferred amount is 5–15% and if more than 30% is used, it is meaningless.

Further, we carried out an experiment in order to check the relation between the treatment temperature, Cr concentration and C concentration of the iron bath, with respect to Cr pig irons respectively containing 12% Cr, 18% Cr and 25% Cr. Each Cr pig iron was melted in a magnesia crucible, and a graphite ring was floated, into which slag was placed. For 12% Cr pig iron, a $K_2CO_3$ 15%-CaO 10%-$CaF_2$ 50%-FeO 25% slag was used and for 18% Cr pig iron and 25% Cr pig iron, a $Na_2CO_3$ 15%-CaO 10%-$CaF_2$ 50%-FeO 25% slag was used. Each slag was used in an amount of 70 g/kg-metal. The results are summarized in Table 1.

TABLE 1

| | | | | | | | | |
|---|---|---|---|---|---|---|---|---|
| % Cr | 12 | | 18 | | 25 | | | |
| % C | 5 | | 5.5 | | 6 | | | |
| Lower limit temp. calculated from the above inequality (°C.) | 1375 | | | 1393 | | | 1406 | |
| Test temperature (°C.) | 1350 | 1400 | 1380 | 1430 | 1580 | 1750 | 1400 | 1450 |
| Degree of Denitrification | Δ | ○ | Δ | ○ | ○ | ○ | Δ | ○ |
| Degree of Dephosphorization | ▲ | • | ▲ | • | • | ▲ | ▲ | • |

○: good (≧60%), •: good (≧50%),
Δ: failure (<60%), ▲: failure (<50%)

Further the invention is illustrated by way of working examples.

One hundred (100) kg of Cr pig iron containing 18% Cr, 6% C and less than 0.05% Si was melted in a graphite crucible by means of a high frequency induction furnace. Slags the compositions of which are indicated in Table 2 were added in 3 portions at 5 minutes intervals. The metal and slag was stirred by blowing in argon (Ar) through the porous plug provided at the bottom of the crucible. The treatment was continued for 15 minutes, during which the temperature was maintained at 1550° C. in all the examples except Example 12, in which it was maintained at 1800° C. The compositions of the metal before and after the treatment are shown in Table 2.

As comparative examples, the same operations were carried out under the same conditions using slags the compositions of which are indicated in Table 2. Provided that in Comparative Example 13, Cr pig iron containing 18% Cr, 1% C and <0.05% Si was melted in a magnesia crucible, and a graphite ring was floated on the iron bath, into which a slag was placed. The compositions of the metal before and after the treatment were shown in Table 2, too. In the comparative examples, degree of dephosphorization and denitrification are low because the used slags lack the halide component, or the oxide component, or the used amount was improper, the amount of the alkaline earth metal compound concentration was too large, or the C concentration of the molten iron was low, although the amount of the used alkali metal compound component was on the same level as the working examples.

TABLE 2

| Ex. No. | | Time of sampling | Metal Composition (%) P | Cr | N | Slag Composition | Amount (kg) | Remarks |
|---|---|---|---|---|---|---|---|---|
| Working Examples | 1 | Before treatment | 0.030 | 18.14 | 0.020 | $K_2CO_3$ 13% — CaO 10% — | 3 | |
| | | After treatment | 0.015 | 17.95 | 0.003 | $CaF_2$ 57% — $Fe_2O_3$ 20% | | |
| | 2 | Before treatment | 0.034 | 30.05 | 0.030 | $Na_2CO_3$ 10% — CaO 15% 6 | | |
| | | After treatment | 0.017 | 29.23 | 0.009 | — $CaCl_2$ 55% — $Fe_2O_3$ | | |
| | 3 | Before treatment | 0.027 | 17.98 | 0.018 | KOH 10% — $CaF_2$ 60%— | 4 | |
| | | After treatment | 0.010 | 17.80 | 0.005 | $Fe_2O_3$ 30% | | |
| Comparative Examples | 4 | Before treatment | 0.028 | 18.07 | 0.019 | $K_2CO_3$ 20% — | 3 | Poor dephosphorization and denitrification because of absence of the halide component. |
| | | After treatment | 0.026 | 17.95 | 0.013 | $Fe_2O_3$ 80% | | |
| | 5 | Before treatment | 0.030 | 18.28 | 0.019 | $Na_2CO_3$ 8% — CaO 50% | 6 | Amount of CaO was in excess of 40%, and thus the slag solidified impairing reaction. |
| | | After treatment | 0.026 | 18.15 | 0.014 | $CaF_2$ 32% — FeO 10% | | |

TABLE 2-continued

| Ex. No. | | Time of sampling | Metal Composition (%) P | Cr | N | Slag Composition | Amount (kg) | Remarks |
|---|---|---|---|---|---|---|---|---|
| | 6 | Before treatment | 0.028 | 18.33 | 0.019 | $K_2CO_3$ 10% — CaO 20% | 5 | Poor dephosphorization and denitrification because of absence of the oxide component. Oxidation of molten bath insufficient. |
| | | After treatment | 0.027 | 18.30 | 0.013 | $CaF_2$ 70% | | |
| | 7 | Before treatment | 0.031 | 18.07 | 0.023 | $Na_2CO_3$ 10% — $CaF_2$ 35% | 5 | Amount of FeO was in excess of 50%, and thus the slag solidified resulting in insufficient dephosphorization and denitrification. |
| | | After treatment | 0.027 | 17.97 | 0.019 | — FeO 55% | | |
| Working Examples | 8 | Before treatment | 0.027 | 17.90 | 0.021 | $Na_2CO_3$ 6% — CaO 5% — | 5 | |
| | | After treatment | 0.009 | 17.65 | 0.003 | $CaCl_2$ 59% — NiO 30% | | |
| | 9 | Before treatment | 0.025 | 17.27 | 0.021 | $K_2CO_3$ 7% — $CaCO_3$ 10% | 5 | |
| | | After treatment | 0.010 | 17.07 | 0.004 | — $CaCl_2$ 53% — FeO 30% | | |
| | 10 | Before treatment | 0.029 | 17.50 | 0.026 | NaOH 8% — CaO 20% — | 5 | |
| | | After treatment | 0.010 | 17.32 | 0.005 | $CaF_2$ 52% — $Fe_2O_3$ 20% | | |
| | 11 | Before treatment | 0.025 | 17.43 | 0.020 | $K_2CO_3$ 10% — CaO 20% | 5 | |
| | | After treatment | 0.010 | 17.24 | 0.003 | — $CaF_2$ 50% — $Fe_2O_3$ 20% | | |
| | 12 | Before treatment | 0.023 | 17.54 | 0.025 | $Na_2CO_3$ 10% — CaO 30% | 8 | Temperature was too high. Only denitrification occurred. |
| | | After treatment | 0.023 | 17.48 | 0.006 | — $CaF_2$ 35% — FeO 25% | | |
| Comparative Examples | 13 | Before treatment | 0.031 | 18.24 | 0.022 | $K_2CO_3$ 13% — CaO 10% — | 3 | C concentration less than 2%. Cr oxidation was promoted instead of dephosphorization and denitrification. |
| | | After treatment | 0.030 | 17.79 | 0.019 | $CaF_2$ 57% — $Fe_2O_3$ 20% | | |

INDUSTRIAL USEFULNESS

The process of this invention is effective and economical for dephosphorization and denitrification of the Cr pig iron. That is, by the employment of the slag in which rather small amount of expensive alkali metal compounds are incorporated in a specific composition, the refining power of the slag is maintained high. Thus cost of the slag is drastically reduced and, the process is commercially valuable. Further generation of dust and fume, which is incidental to the use of alkali metal compounds, is reduced, and thus operation efficiency has been remarkably improved. Incidentally, by the process of this invention, desulfurization is simultaneously effected, too.

What we claim is:

1. A process for dephosphorization-denitrification of molten pig iron containing not less than 3% Cr, comprising maintaining the C concentration of said molten pig iron at not less than 2% by weight, contacting said pig iron with a slag comprising more than 30% to 70% by weight of at least one selected from fluorides and chlorides of alkaline earth metals, 1.5 to less than 30% by weight of at least one of oxides, hydroxides and carbonates of sodium and potassium, 5–50% by weight of at least one of oxides of iron and nickel and from 0% to less than 40% by weight of at least one of oxides and carbonates of alkaline earth metals, while controlling oxidation of Cr.

2. The process as claimed in claim 1, wherein the Si concentration of the molten bath is maintained at 0.2% by weight or less.

3. The process as claimed in claim 1 or 2, wherein control of oxidation of Cr is effected by reducing the partial pressure of CO of the atmosphere.

4. The process as claimed in claim 3, wherein reduction of the partial pressure of CO is effected by contacting a gaseous mixture of oxygen and inert gas with the molten iron bath.

5. The process as claimed in claim 3, wherein reduction of the partial pressure of CO is effected by evacuation of the atmosphere.

6. The process as claimed in claim 1 or 2, wherein control of oxidation of Cr is effected by lowering the oxygen potential of the iron bath.

7. The process as claimed in claim 6, wherein the oxygen potential of the iron bath is lowered by raising the C content of the bath.

8. The process as claimed in claim 7, wherein the C content is maintained at not less than 5%.

9. The process as claimed in claim 8, wherein the C content is maintained at not less than 6%.

10. The process as claimed in claim 7, wherein the relation between C concentration, Cr concentration and temperature of the iron bath is maintained in the relation represented by the following inequality:

$$1850^\circ C. \geqq t^\circ C. \geqq [-35960/\{\log([\%Cr]^2/[\%C]^3)-21.88\}-273]^\circ C.$$

11. The process as claimed in claim 10, wherein the temperature is not higher than 1600° C.

12. The process as claimed in claim 1 or 2, wherein the slag contains 35–60% by weight of at least one of fluorides and chlorides of alkaline earth metals, 3–20% of at least one of oxide, hydroxide and carbonate of sodium and potassium, 15–50% by weight of at least one of oxides of iron and nickel, and 0–less than 40% by weight of at least one of oxides and carbonates of alkaline earth metals.

13. The process as claimed in claim 1 or 2, wherein the slag contains 40–60% by weight of at least one of fluorides and chlorides of alkaline earth metals, 5–15% by weight of oxides, hydroxides and carbonate of sodium and potassium, 20–40% by weight of oxides of iron and nickel, and from 0%–less than 40% by weight of at least one of oxides and carbonates of alkaline earth metals.

14. The process as claimed in claim 12, wherein the slag contains 5–20% by weight of at least one selected from oxides and carbonates of alkaline earth metals.

15. The process as claimed in claim 13, wherein the slag contains 7–15% by weight of at least one selected from oxides and carbonates of alkaline earth metals.

* * * * *